US010854064B1

(12) United States Patent
Warren et al.

(10) Patent No.: US 10,854,064 B1
(45) Date of Patent: Dec. 1, 2020

(54) SECURITY SYSTEM WITH EARTHQUAKE DETECTION

(71) Applicant: Vivint, Inc., Provo, UT (US)

(72) Inventors: Jeremy B. Warren, Draper, UT (US); Jeffrey G. Thomas, Draper, UT (US)

(73) Assignee: Vivint, Inc., Provo, UT (US)

( * ) Notice: Subject to any disclaimer, the term of this patent is extended or adjusted under 35 U.S.C. 154(b) by 0 days.

(21) Appl. No.: 16/140,341

(22) Filed: Sep. 24, 2018

Related U.S. Application Data

(63) Continuation of application No. 15/419,345, filed on Jan. 30, 2017, now Pat. No. 10,115,285, which is a continuation of application No. 14/193,165, filed on Feb. 28, 2014, now Pat. No. 9,558,644.

(60) Provisional application No. 61/793,724, filed on Mar. 15, 2013.

(51) Int. Cl.
*G08B 21/10* (2006.01)
*G08B 27/00* (2006.01)

(52) U.S. Cl.
CPC ..... *G08B 21/10* (2013.01); *G08B 27/00* (2013.01)

(58) Field of Classification Search
CPC ..... G08B 21/10; G08B 27/00; G08B 27/05
See application file for complete search history.

(56) References Cited

U.S. PATENT DOCUMENTS

| | | | | |
|---|---|---|---|---|
| 7,005,993 | B2 | 2/2006 | Webb et al. | |
| 7,109,879 | B2 | 9/2006 | Stults et al. | |
| 8,489,063 | B2 | 7/2013 | Petite | |
| 8,527,306 | B1 | 9/2013 | Reeser et al. | |
| 2008/0270034 | A1* | 10/2008 | Friedlander | G01V 1/008 702/15 |
| 2009/0033511 | A1* | 2/2009 | Komiya | G01V 1/008 340/690 |
| 2009/0303070 | A1* | 12/2009 | Zhang | G08B 21/10 340/690 |
| 2009/0326821 | A1 | 12/2009 | Yomoda et al. | |
| 2011/0305294 | A1 | 12/2011 | Moriya et al. | |
| 2012/0280823 | A1 | 11/2012 | Yang | |
| 2013/0328688 | A1* | 12/2013 | Price | G08B 21/10 340/690 |
| 2014/0253321 | A1 | 9/2014 | Srinivasan et al. | |

* cited by examiner

*Primary Examiner* — Hongmin Fan
(74) *Attorney, Agent, or Firm* — Holland & Hart, LLP

(57) ABSTRACT

The present disclosure relates to approaches for detecting and monitoring for earthquakes using a control unit of a security system. A security system may include a plurality of sensors that detect alarm conditions and send alarm condition messages to a control unit for the security system. The control unit may be communicatively coupled to the sensors and configured to receive the alarm condition messages from the sensors. The security system may also include an earthquake sensor that senses earthquake conditions and sends an earthquake condition message to the control unit if it detects the earthquake condition. The control unit may include an alarm module. The control unit causes the alarm module to generate an alarm in response to receiving the earthquake condition message from the earthquake sensor.

20 Claims, 7 Drawing Sheets

SECURITY SYSTEM WITH EARTHQUAKE DETECTION

CROSS REFERENCES

The present Application is a continuation of U.S. patent application Ser. No. 15/419,345, titled: "SECURITY SYSTEM WITH EARTHQUAKE DETECTION," filed on Jan. 30, 2017, which is a continuation of U.S. patent application Ser. No. 14/193,165, titled: "SECURITY SYSTEM WITH EARTHQUAKE DETECTION," filed on Feb. 28, 2014, which claims priority to U.S. Provisional Patent Application No. 61/793,724, titled: "SECURITY SYSTEM WITH EARTHQUAKE DETECTION," filed on Mar. 15, 2013. The disclosures of each of which are incorporated by reference herein in their entirety.

TECHNICAL FIELD

This disclosure relates generally to security systems and, more specifically, to security systems configured to detect earthquakes and provide appropriate warnings.

BACKGROUND OF RELATED ART

Security systems are widely used to protect property and provide personal safety. Security systems generally include a control unit that controls the overall operation of the system, one or more keypads providing user access to the system, and various detectors and sensors.

Security systems may generate an alarm in response to any number of events, such as an unauthorized entry, fire, medical emergency, or manual alarm activation. The security system may be associated with a service that remotely monitors the status of the security system. Thus, if the security system generates an alarm, a notification signal may be transmitted via a wired and/or wireless communications link to a monitoring system. Upon receiving the notification, security service personnel for the monitoring system may attempt to contact the property owner or other party at the facility to verify the alarm. If it is appropriate to do so, a security service representative may, upon confirmation of the alarm, contact an emergency response agency such as the police department, the fire department, an emergency medical team, or other appropriate entity.

For those living in earthquake zones, the threat of an earthquake is a frequent source of worry. While some dangerous natural events, such as hurricanes, can be forecast with some accuracy, earthquakes remain alarmingly unpredictable. It would be desirable to have a security system that can detect and provide notification of an earthquake to users of the security system.

BRIEF SUMMARY OF THE INVENTION

Disclosed herein are devices and approaches to notifying persons of an imminent earthquake. In one embodiment, a security system includes a control unit that is communicatively coupled to a plurality of sensors and is configured to receive alarm condition messages from those sensors. The sensors may send the alarm condition messages to the control unit if the sensors sense one or more alarm conditions. The system may also include an earthquake sensor that senses earthquake conditions and sends an earthquake condition message to the control unit in response. The earthquake sensor may, for example, sense the primary waves that precede the more destructive waves in an earthquake. The earthquake sensor may be installed at the same location as the control panel.

The control panel may cause an alarm module for the security system to generate an alarm when the control panel receives the earthquake condition message from the earthquake sensor. The alarm may include an audio component (such as a siren, audio instructions, etc.) and a visual component (such as flashing lights, text warning, etc).

The security system may also include a remote earthquake module that is configured to receive earthquake condition notifications from a number of control units. The remote earthquake module may be implemented as part of a monitoring system that is associated with the control unit and that communicates with the control unit over a cellular network. The control unit may transmit earthquake condition notifications to the remote earthquake module when the control unit receives an earthquake condition message from the earthquake sensor. The control unit may also receive earthquake alert messages from the remote earthquake module and generate an alarm in response.

In certain embodiments, the control unit may be communicatively connected to other, additional control units for separate security systems. The control unit may send an earthquake alert message to addresses for the additional control units if the earthquake sensor associated with the control unit senses an earthquake. The control unit may also be configured to receive earthquake alert messages from the additional control units and to generate an alarm in response.

In one embodiment, the present systems and methods may be embodied as a control unit. The control unit may include a sensor module that is communicatively coupled to sensors and configured to receive alarm condition messages from those sensors if the sensors detect an alarm condition. The control unit may also include an earthquake response module that is communicatively coupled to an earthquake sensor installed at the same facility as the control unit. The earthquake response module may be configured to receive an earthquake condition message from the earthquake sensor if the earthquake sensor detects an earthquake condition. An alarm module of the control panel may generate an alarm if the earthquake response module receives the earthquake condition message.

The earthquake response module may be communicatively coupled to a remote earthquake module implemented within a monitoring system by a cellular network, the Internet, or other appropriate communication link. The earthquake response module may receive earthquake alert messages from the remote earthquake module, and the alarm module may generate an alarm in response. The earthquake response module may send earthquake alert messages to the remote earthquake module if it receives an earthquake condition message from the earthquake sensor.

In certain embodiments, the control unit may include a network module that maintains the control unit as a node in a network of control units. The earthquake response module may be configured to receive earthquake alert messages from at least one of the control units in the network, and the alarm module may be configured to generate an alarm in response to the earthquake response module receiving such a message. The earthquake response module may also be configured to send earthquake alert messages to one or more of the control units in the network when the earthquake sensor associated with the earthquake response module detects an earthquake condition.

Also disclosed is a method for sensing an earthquake condition. The method may involve monitoring the sensors in the security system for alarm condition messages and monitoring an earthquake sensor installed at the location of the security system for earthquake condition messages. The method may also involve generating an audible alarm in response to receiving the earthquake condition message, and sending an earthquake condition notification to a remote server. The method may further involve sending the earthquake alert message to a separate control unit over a network of control units. Similarly, the method may involve receiving an earthquake alert message from a separate control unit over a network of control units. The method may also involve receiving an earthquake alert message from the remote server and generating a visual alarm in response.

A security system is also described. The system may include means for monitoring one or more sensors in a security system for alarm condition messages, means for monitoring an earthquake sensor installed at a location of the security system, means for generating an audible alarm in response to the earthquake sensor detecting an earthquake condition, and means for sending an earthquake condition notification to a separate control unit over a network of control units.

The foregoing has outlined rather broadly the features and technical advantages of examples according to the disclosure in order that the detailed description that follows may be better understood. Additional features and advantages will be described hereinafter. The conception and specific examples disclosed may be readily utilized as a basis for modifying or designing other structures for carrying out the same purposes of the present disclosure. Such equivalent constructions do not depart from the spirit and scope of the appended claims. Features which are believed to be characteristic of the concepts disclosed herein, both as to their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the embodiments may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

Figure 1:
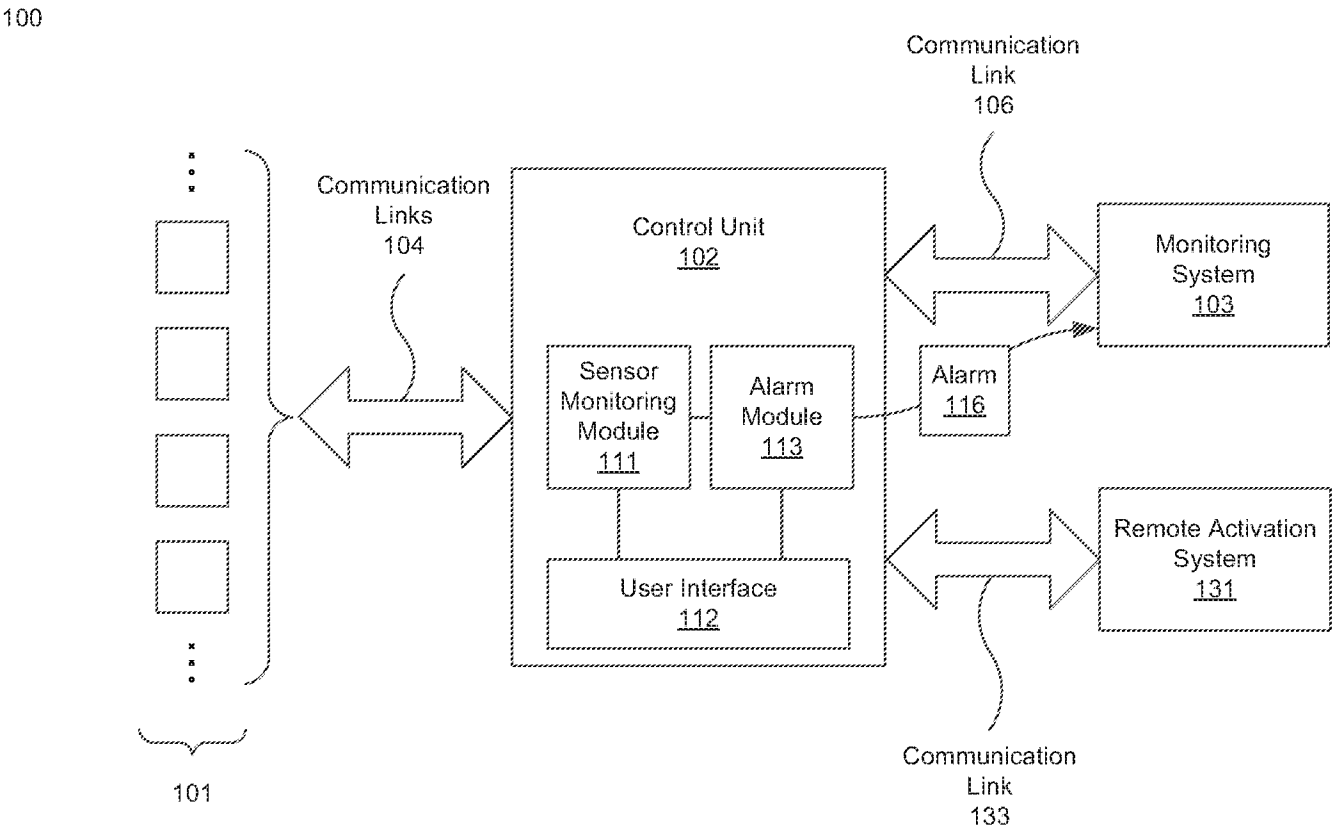
FIG. 1 illustrates an embodiment of a security system.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

Referring in general to the accompanying drawings, various embodiments of the present systems and methods are illustrated to show the structure and methods for installing a component within a system, such as a security system. Common elements of the illustrated embodiments are designated with like numerals. It should be understood that the figures presented are not meant to be illustrative of actual views of any particular portion of the actual device structure, but are merely schematic representations, which are employed to more clearly and fully depict embodiments of the present systems and methods.

The following provides a more detailed description of ways to implement the present systems and methods and various representative embodiments thereof. In this description, functions may be shown in block diagram form in order not to obscure the present disclosure in unnecessary detail. Additionally, block definitions and partitioning of logic between various blocks is exemplary of a specific implementation. It will be readily apparent to one of ordinary skill in the art that the present systems and methods may be practiced by numerous other solutions. For the most part, details concerning timing considerations and the like have been omitted where such details are not necessary to obtain a complete understanding of the present systems and methods and are within the abilities of persons of ordinary skill in the relevant art.

In this description, some drawings may illustrate signals as a single signal for clarity of presentation and description. It will be understood by a person of ordinary skill in the art that the signal may represent a bus of signals, wherein the bus may have a variety of bit widths and the present systems and methods may be implemented on any number of data signals including a single data signal.

FIG. 1 illustrates an embodiment of a security system 100, which may also be referred to as an "alarm system." The security system 100 includes sensors 101, a control unit 102, monitoring system 103, and remote activation system 131. Communication links 104 (which may be a combination of wired and wireless communication links) couple sensors 101 to control unit 102. Wired communication links can include circuit loops that are either detected as closed or open. In some embodiments, sensors 101 and control unit 102 are located in the same facility, such as in the same residence or in the same building. Communication link 106 (which may be a wired telephone connection, wired or wireless network connection, cellular connection, etc., or combination thereof) may couple the control unit 102 to monitoring system 103. In other embodiments, the system shown in FIG. 1 may be implemented without a monitoring system 103. In certain embodiments, the monitoring system 103 may communicate with multiple control units 102 belonging to other security systems.

Sensors 101 monitor for certain events and report relevant events to the control unit 102. Sensors 101 may include any of a variety of different types of sensors, such as door and window sensors, motion sensors, glass break sensors (e.g., sensors that detect a physical break or detecting the sound of a glass break), etc. The control unit 102 may be configured to monitor sensors 101 for alarm conditions via communication links 104 and to relay alarms to the monitoring system 103 via communication link 106. The sensors 101 may, in response to detecting an alarm condition, send an alarm condition message to the control unit 102.

Control unit 102 may include sensor monitoring module 111, user interface 112, and alarm module 113. Sensor monitoring module 111 is configured to monitor sensors 101. Sensors 101 can sense and/or indicate a change in their physical surroundings (e.g., a normally closed connection becomes open, a signal indicating that the sound of breaking glass was detected, etc.) which may be indicative of an unauthorized access, fire, or other event. The sensors 101 may communicate messages on communication links 104. For example, a circuit connected to a door sensor 101 can transition from closed to open (or to a resistance exceeding a pre-determined resistance threshold) indicating that a door has been opened. A motion sensor 101 can send an electrical signal indicative of detected motion. Sensor monitoring module 111 may monitor communication links 104 for alarm condition messages sent from sensors 101. Upon sensor monitoring module 111 receiving an alarm condition message signaling occurrence of an alarm condition, sensor monitoring module 111 may send a signal to alarm module 113.

The alarm module 113 may validate the alarm condition has occurred before communicating with the monitoring system 103 or generating an alarm using the alarm 116. For example, the alarm module 113 may validate an alarm condition indicating that a window is open when the security system is on, but may not validate the same alarm condition when the security system is off.

The alarm module 113 may cause an alarm 116 to generate an alarm in response to validating the alarm condition has occurred. The alarm 116 may provide an audio signal (such as beeping, audio instructions, or other suitable audio), a visual signal (such as a flashing light) or a combination thereof to alert a user to the alarm condition. Where the control unit 102 is associated with one or more controllers providing home automation features, the control unit 102 may also use those features to provide an alarm. For example, the control unit 102 may flash one or more interior lights as part of the alarm.

User interface 112 can include an input interface and an output interface. The input interface can include a physical input interface or virtual input interface that may include a numeric key pad (e.g., for entering a disarm code, etc.), sensor activation buttons, physical duress buttons, or other input/output devices. The input interface can include a condenser for receiving audio input and/or communicating with monitoring system 103. The output interface may include an output display device that displays system status, such as armed and disarmed, sensors/zones that have detected change in physical surroundings, and other relevant information. The output interface can also include a speaker that audibly outputs information similar to that displayed on the output display device. The speaker can also be used by monitoring system 103 to communicate with a user of control unit 102. Other input/output approaches may also be implemented as part of the user interface 112.

The control unit 102 may also communicate over a communication link 133 with a remote activation system 131. The remote activation system 131 may allow a user to interact with the control unit 102 remotely. For example, the user may be able to arm and disarm the system 100 from a mobile device such as a cellular phone using the remote activation system 131.

Figure 2:
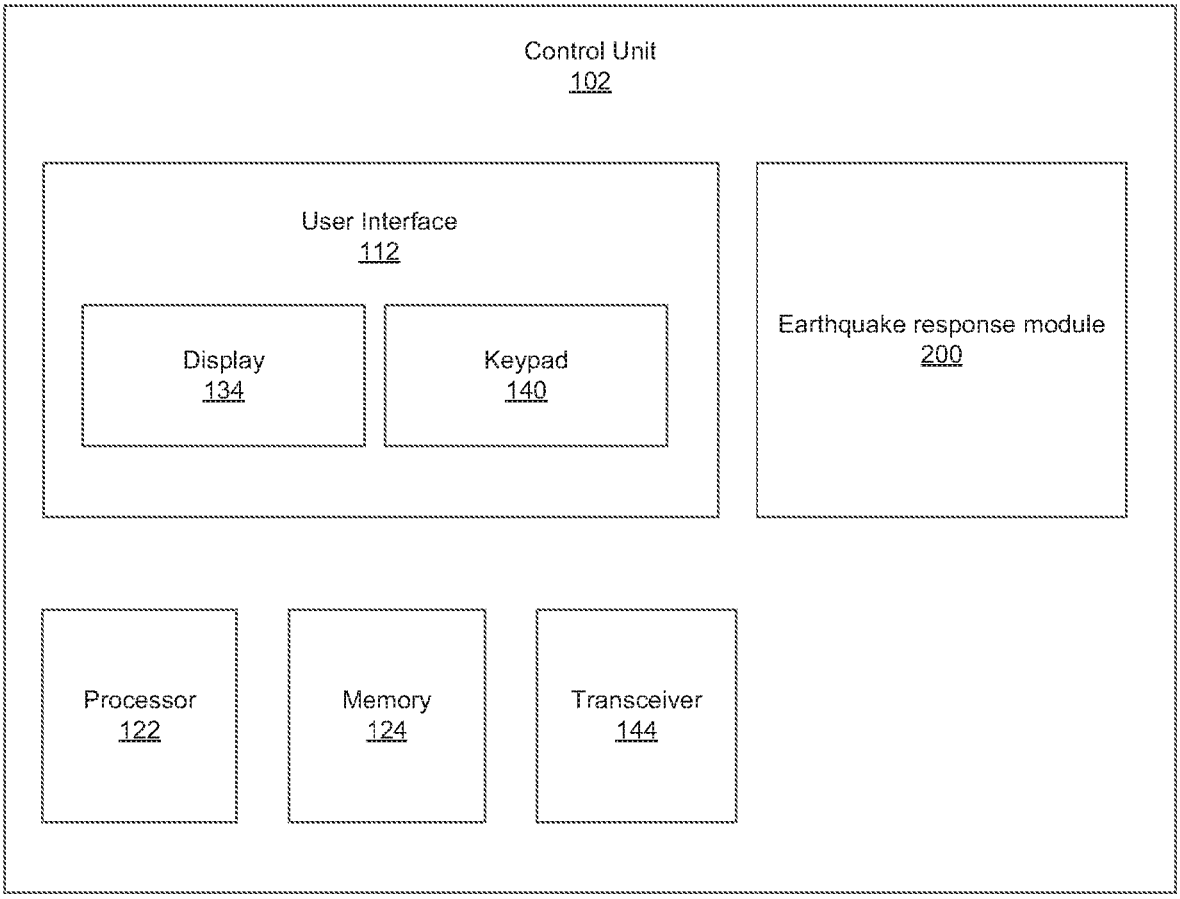
FIG. 2 is a block diagram of an embodiment of a control unit of a security system.

FIG. 2 is a block diagram of one embodiment of a control unit 102. Control unit 102 may include a processor 122, memory 124, transceiver 144, and user interface 112. User interface 112 may include various input/output (I/O) devices, such as a display 134, which may comprise a touch screen, and keypad 140. Control unit 102 may further include a transceiver 144 for receiving and transmitting data over a network. It is noted that a "communication interface" as referred to herein may comprise transceiver 144 and user interface 112. The control unit 102 may be capable of communicating over more than one network; for example, the control unit 102 may be capable of communicating with a radio frequency identification (RFID) tag, a wireless Internet network, a cellular network, and others.

Generally, control unit 102 may operate under control of an operating system stored in memory 124, and interface with a user to accept inputs and commands and to present outputs through user interface 112. Control unit 102 may also implement a compiler (not shown), which allows one or more application programs (not shown) written in a programming language to be translated into processor 122 readable code. Instructions implementing an application program may be tangibly embodied in a non-transitory computer-readable medium. Further, an application program may include instructions which, when read and executed by processor 122, cause processor 122 to perform the steps necessary to implement and/or use embodiments of the present disclosure. It is noted that an application program and/or operating instructions may also be tangibly embodied in memory 140 and/or data communications devices, thereby making a computer program product or article of manufacture according to an embodiment the present disclosure. As a result, the term "application program" as used herein is intended to encompass a computer program accessible from any computer readable device or media. Furthermore, portions of the application program may be distributed such that some of the application program may be included on a computer readable media within control unit 102, and some of the application program may be included in a remote device, such as a remote computer.

The control unit 102 may thus be a component in a security system and/or a building automation system. The control unit 102 may provide security and/or automation functionality for a residence, an office, a building, or other appropriate space.

In many embodiments, the control unit 102 may be realized as a control panel. As used herein, the term "control panel" refers to a standalone, dedicated unit for providing security and/or building automation functionality. The term "control panel" does not include a general purpose computer, smart phone, tablet, or other general purpose device that may run an application providing some security/automation functionality.

The control unit 102 may further include an earthquake response module 200. The earthquake response module 200 may be software, firmware, hardware, or a combination thereof. The earthquake response module 200 communicatively couples with an earthquake sensor that is installed at the same facility as the control unit 102. The earthquake response module 200 receives an earthquake condition message from the earthquake sensor, and provides an appropriate alarm to warn those at the facility of the earthquake.

Figure 3:
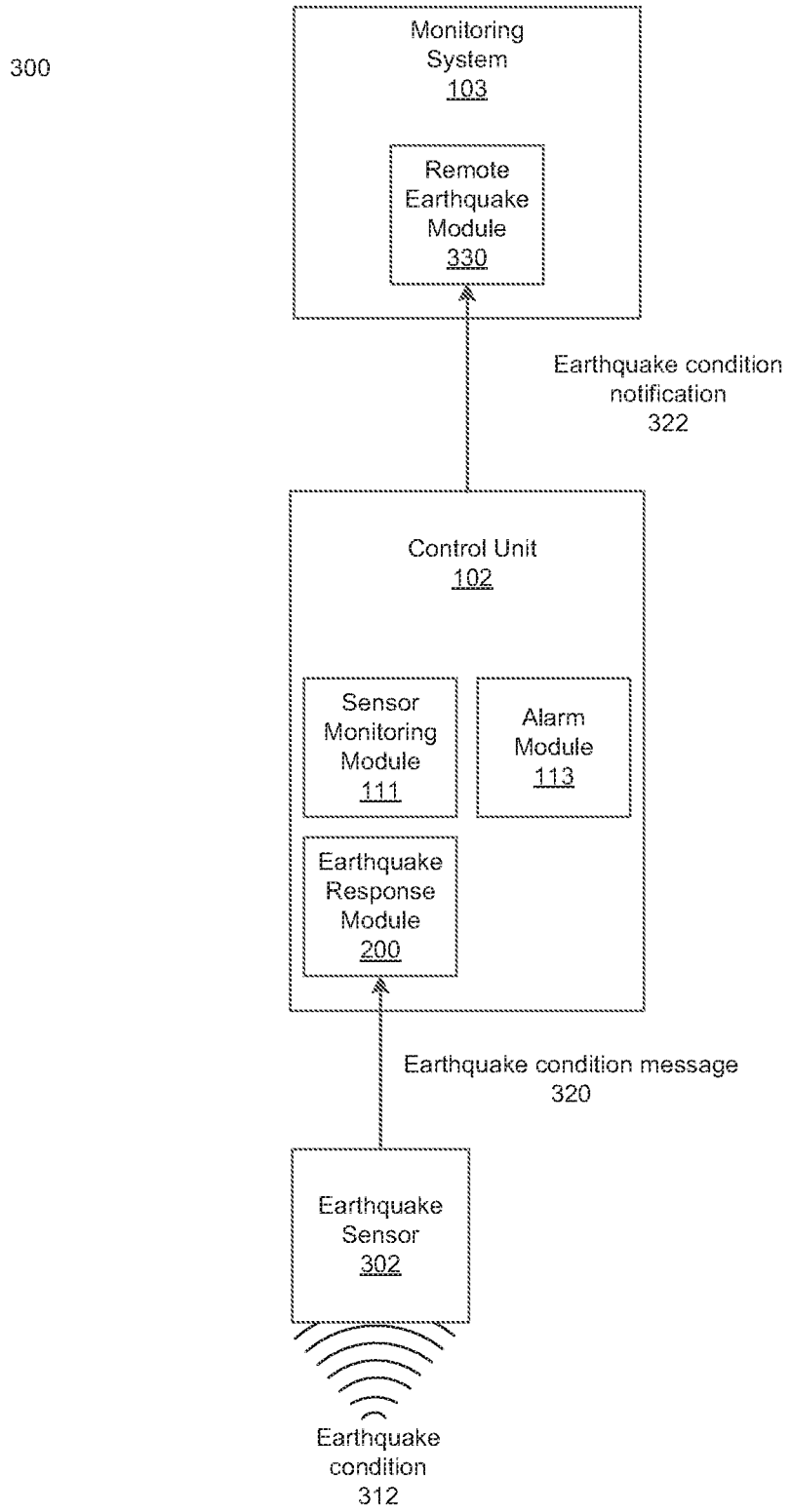
FIG. 3 is a schematic block diagram illustrating one embodiment of a system including a monitoring system, a control unit, and an earthquake sensor.

FIG. 3 illustrates one embodiment of a system 300 including a monitoring system 103, a control unit 102, and an earthquake sensor 302. The earthquake sensor 302 and the control unit 102 may be installed at the same physical facility, while the monitoring system 103 may be located at a remote facility. The control unit 102 may have a wired connection with the earthquake sensor 302 or a wireless connection that allows the earthquake sensor 302 to send information to the control unit 102.

The earthquake sensor 302 detects one or more earthquake conditions 312 that indicate that an earthquake is occurring. In response to detecting an earthquake condition 312, the earthquake sensor 302 sends an earthquake condition message 320 to the control unit 102 in response to detecting the earthquake condition 312. The earthquake condition message 320 is a message that at least indicates that the earthquake sensor 302 has sensed an earthquake condition 312.

The earthquake sensor 302 may, for example, detect waves generated by an earthquake. An earthquake generates primary waves (also known as pressure waves or P waves), secondary waves (also known as shear waves or S waves), Love waves (also known as Q waves or L waves), and Rayleigh waves (also known as R waves). The P waves are the fastest waves generated by an earthquake, and are generally non-destructive. In one embodiment, the presence of P waves, sensed by the earthquake sensor 302, is an earthquake condition 312. The earthquake sensor 302 senses the P waves and generates the earthquake condition message 320 in response. It is typical that such an embodiment would provide approximately one second of warning time for every five miles of distance between the earthquake sensor 302 and the epicenter of the earthquake.

The earthquake sensor 302 may include a seismometer for measuring the motion of the ground such that the earthquake sensor 302 can detect earthquakes. The seismometer may use electronic sensors and be configured to measure motions over a wide range of frequencies. The earthquake sensor 302 may, in one embodiment, measure motion with frequencies of between 0.001 Hz and 500 Hz. The seismometer may include a small mass that is maintained substantially stationary by electrical forces. The amount of force necessary to maintain the mass in a substantially stationary position is then used to determine information about the seismic event. The earthquake sensor 302 may include a geophone, a broadband seismograph, an accelerograph, or other suitable device for detecting seismic events.

In certain embodiments, the earthquake sensor 302 and/or the earthquake response module 200 may be configured to filter out smaller earthquakes such that no alarm is generated in response. For example, the earthquake sensor 302 may be configured to send the earthquake condition message 320 only in response to an earthquake of a magnitude of approximately 4.0 on the Richter scale. Such an approach may prevent an alarm from sounding for earthquakes that are unlikely to cause damage or to require action on the part of people in the facility associated with the earthquake sensor 302.

The earthquake response module 200, in response to receiving the earthquake condition message 320, may cause the alarm module 113 to generate an alarm. The alarm module 113 may generate an alarm with an audio component. For example, the alarm may include an audible beep or siren. The alarm may provide audible instructions or other verbal warning; for example, the alarm may state that an earthquake is imminent and instruct users to seek cover. The alarm may also have a visual component. For example, the alarm may include flashing lights, a message displayed on a display panel for the control unit 102, a message on a television in communication with the alarm module 113, or other suitable visual alert.

The system 300 may also include a remote earthquake module 330. The remote earthquake module 330 may, in one embodiment, be implemented as part of the monitoring system 103. The monitoring system 103 may connect to the control unit 102 through one or more networks; for example, the control unit 102 and the monitoring system 103 may be connected through the Internet, a wireless cellular network, or other type of network. In one embodiment, the monitoring system 103 and the control unit 102 may be connected through more than one network; such an implementation may provide additional redundancy and help guard against network failure and network congestion.

The remote earthquake module 330 may be software executing on a remote server in communication with the control unit 102. In certain embodiments, the earthquake response module 200 is configured to send an earthquake condition notification 322 to the remote earthquake module 330. An earthquake condition notification 322 refers to a communication indicating the occurrence of an earthquake condition 312 detected by an earthquake sensor 302. In certain embodiments, the earthquake condition message 320 and the earthquake condition notification 322 contain the same substantive information. The formatting and content of the earthquake condition notification 322 may be different in order to account for different protocols. For example, the earthquake sensor 302 may send the earthquake condition message 320 using the Z-Wave wireless communications protocol. The control unit 102 may send the earthquake condition notification 322 using the hypertext transfer protocol (HTTP), and may include additional and/or different information than the earthquake condition message 320.

In one embodiment, the earthquake condition message 320 sent by the earthquake sensor 302 includes one or more readings by the earthquake sensor 302 that caused the earthquake sensor 302 to determine that an earthquake condition 312 had occurred. The earthquake condition message 320 sent by the earthquake sensor 302 may also include additional information, such as the times at which the readings were made. The control unit 102 may add additional information to the earthquake condition notification 322 sent to the remote earthquake module 330. For example, the control unit 102 may provide an identifier that uniquely identifies the control unit 102, location information that identifies the location of the control unit 102 (such as geographic information system (GIS) data), and other information in addition to the readings by the earthquake sensor 302.

In certain embodiments, the earthquake response module 200 may be configured to also send the earthquake condition notification 322 to one or more mobile devices. For example, the earthquake response module 200 may send an earthquake condition notification 322 to one or more cellular phones or other devices registered with the control unit 102. The earthquake response module 200 may send an earthquake condition notification 322 to any device registered with the remote activation system 131 shown in FIG. 1. In one embodiment, the earthquake response module 200 sends a short message service (SMS) text message to cellular phones registered with the control unit 102. Other forms of earthquake condition notification 322, such as an email, a pre-recorded voice message, or other, may also be used.

Such an earthquake condition notification 322 may allow the control unit 102 to warn associated users even if they are not at the facility when the earthquake condition 312 is detected.

Similarly, alerts to mobile devices (whether for an earthquake or a tsunami) may be valuable for remote individuals even if the alert is not received prior to the event. An individual responsible for a particular facility may want to be aware of a significant event such as an earthquake or tsunami immediately before or after. For example, a manager for a company with a large data center may want to be alerted to earthquakes, and related events, at the data center facility even if the manager is situated in another part of the country.

Figure 4:
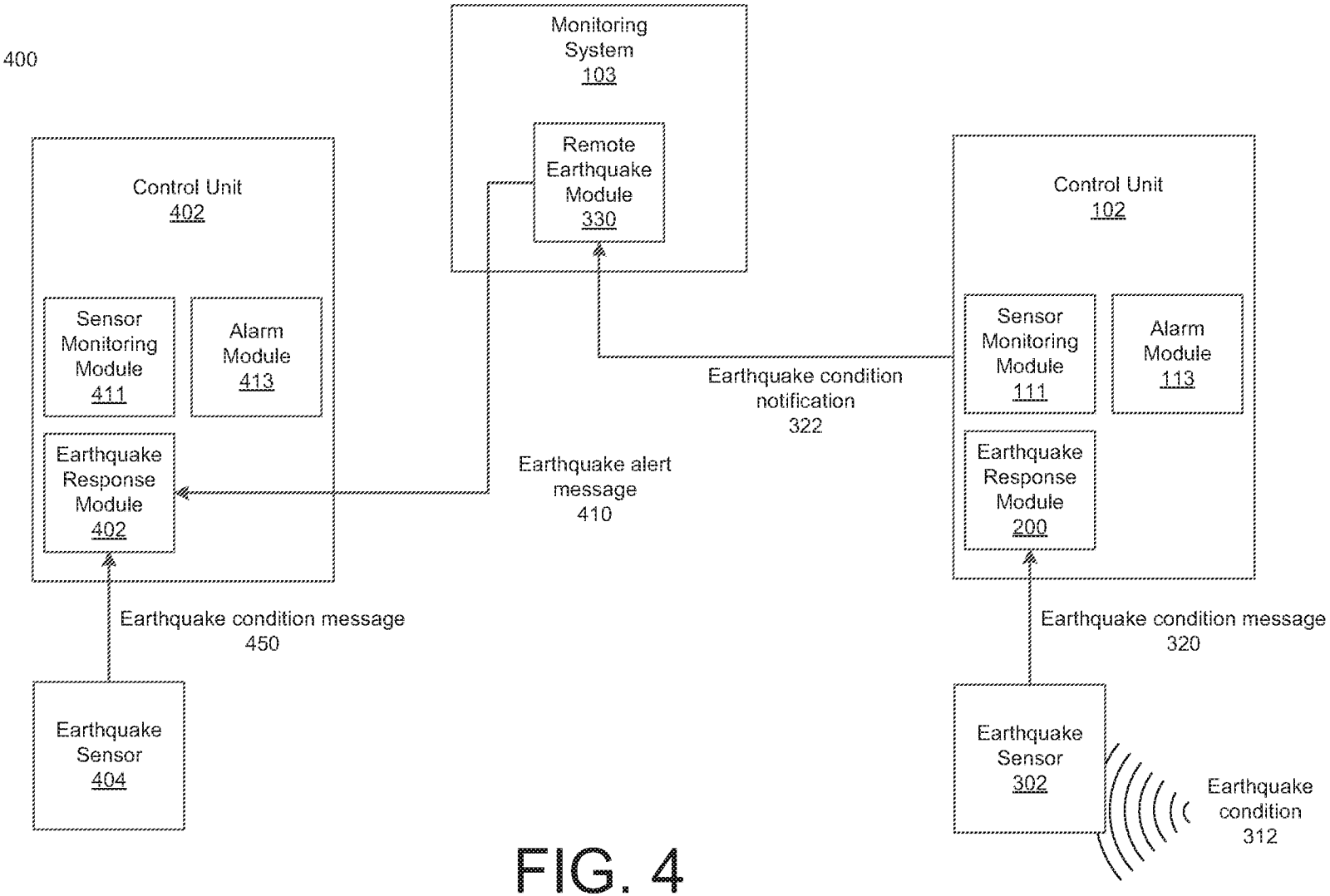
FIG. 4 is a schematic block diagram illustrating one embodiment of a system including a monitoring system, and multiple control units and earthquake sensors.

FIG. 4 shows one embodiment of a system 400 that includes a first control unit 102, a monitoring system 103, and a second control unit 402. The control units 102 and 402 may be configured with respective earthquake response modules 200 and 402, and may communicate with respective earthquake sensors 302 and 404. The remote earthquake module 330 may be in communication with a plurality of control units, such as control unit 102 and control unit 402 illustrated in FIG. 4. While FIG. 4 illustrates the remote earthquake module 330 in communication with two control units, in typical embodiments, the remote earthquake module 330 is in communication with numerous control units across a wide geographic range. The remote earthquake module 330 may be connected to, and configured to receive earthquake condition notifications 322 from a large number of control units spread over a city, a state, and/or a country.

The earthquake sensor 302 may detect an earthquake condition 312 and send an earthquake condition message 320 to the control unit 102, as described above in connection with FIG. 3. The control unit 102 may also send an earthquake condition notification 322 to the remote earthquake module 330.

The remote earthquake module 330 may be configured to generate one or more earthquake alert messages 410 that are sent from the monitoring system 103 to one or more control units (such as control unit 402) that are separate from the control unit (in FIG. 4, control unit 102) that generated the earthquake condition notification 322. In the embodiment shown, the remote earthquake module 330 receives the earthquake condition notification 322 from the control unit 102 and sends the earthquake alert message 410 to the earthquake response module 402 of the control unit 402. The earthquake response module 402 may be configured to cause the alarm module 413 to generate an alarm indicating an imminent earthquake even before the earthquake response module 402 receives an earthquake condition message 320 from the earthquake sensor 404 associated with the control unit 402. Such an embodiment may provide an earlier warning of an earthquake than a system with a locally-installed earthquake sensor 404 alone.

The remote earthquake module 330 may further implement a model to predict the scope and character of the earthquake based on the earthquake condition notifications 322 received from multiple control units. The model may determine which control units 102 receive earthquake alert messages 410. The model may account for the geographic conditions of the areas where the control units are located. For example, the model may take into account the locations of faults, historic patterns of seismic activity in a particular area, and other factors. In this manner, the remote earthquake module 330 may make intelligent predictions about an anticipated size and scope of an earthquake detected by one or more earthquake sensors providing seismic information to the remote earthquake module 330, and provide an earthquake alert message to all control units within a geographic area that the model predicts will be affected by the earthquake.

In certain embodiments, the remote earthquake module 330 may be further configured to communicate with a public earthquake early warning system. A public earthquake early warning system generally makes use of a system of seismic motion sensors arranged throughout a particular region and use high-speed communications systems to collect readings from those motion sensors. The public earthquake early warning system may also include one or more computers that estimate the size, scope, and/or progression of an earthquake, as well as such local factors as the type of soil in the area. Based on such calculations, the public earthquake early warning system may send warnings to people in the anticipated affected areas. For example, the public earthquake warning system may send warnings using television, radio, mobile devices, and other appropriate devices to communicate with users.

The remote earthquake module 330 may receive warnings from the public earthquake early warning system and send earthquake alert messages to control units (such as control units 402 and 102) in communication with the monitoring system 103. The control units 402 and 102 that receive such an earthquake alert message may generate an alarm to warn persons at the facility as described above. In other embodiments, the control units are configured to receive the warnings from the public earthquake early warning system directly from the public earthquake early warning systems itself.

In certain embodiments, the public earthquake early warning system sends warnings about the earthquake event itself; in other embodiments, the public earthquake early warning system also sends warnings about earthquake-related events. For example, the public earthquake early warning system may send a warning of a possible tsunami. In certain situations, the earthquake itself may pose little risk while the tsunami it causes poses a large risk. In such embodiments, the control units may thus receive and warn of an incoming tsunami.

In certain areas where tsunamis are a risk, the earthquake response module 200 may be configured to behave differently than an earthquake response module 200 in an area where a tsunami is not a risk. For example, the earthquake response module 200 may be configured to provide a warning even for those earthquakes that are too far away to pose a serious threat to the facility if the earthquake occurred in a location, and with sufficient magnitude, that a tsunami is a risk.

The remote earthquake module 330 may be further configured to send data derived from earthquake condition notifications 322 to the public earthquake early warning system. The public earthquake early warning system may use such data in order to further refine the predictions of the affected area and other information related to the earthquake.

In certain embodiments, the nature of the alarm may vary based on the entity communicating with the control unit 402. In one embodiment, the earthquake response module 402 generates a first message indicating that the warning has been generated based on measurements of the earthquake sensor 404 if an earthquake condition message 450 is received. A second message may be provided if the earthquake response module 402 receives an earthquake alert message 410 due to a warning provided by a public earthquake early warning system. For example, the second message may state "Your public earthquake early warning system is providing an earthquake warning. Please prepare for a powerful earthquake."

The earthquake sensor 404 may be configured to provide the earthquake condition message 450 when the earthquake condition 312 is detected even if an earthquake alert message 410 has already been received by the control unit 402. The earthquake response module 402 may still send an earthquake condition notification to the remote earthquake module 330 even if the earthquake response module 402 has already received the earthquake alert message 410. Such an embodiment may allow the remote earthquake module 330 to gather additional data about the earthquake. For example, if the remote earthquake module 330 generates an earthquake alert message 410 based on an earthquake condition notification 322, but the earthquake sensor 404 never reports an earthquake condition 312, the earthquake alert message 410 may have been a false alert. Configuring the earthquake response module 402 in the manner described above may help the remote earthquake module 330 detect false alarms. The model used by the remote earthquake module 330 may be further refined in order to reduce the likelihood of future false alerts.

Similarly, the remote earthquake module 330 may be able to gather information about the earthquake in real time from the various earthquake sensors deployed throughout the system 400 and dynamically predict the strength and direction of the earthquake and adjust which control units are to be sent earthquake alert messages 410 appropriately. The remote earthquake module 330 may further be configured to provide the data received in the earthquake condition notifications 322 to the public earthquake early warning system. Sharing this data may further benefit the community by providing data that may be helpful in refining earthquake models and the public earthquake early warning system. Such an embodiment may also allow the individual earthquake sensors in various facilities to act as an extension of the public earthquake early warning system to the benefit of the community as a whole.

Figure 5:
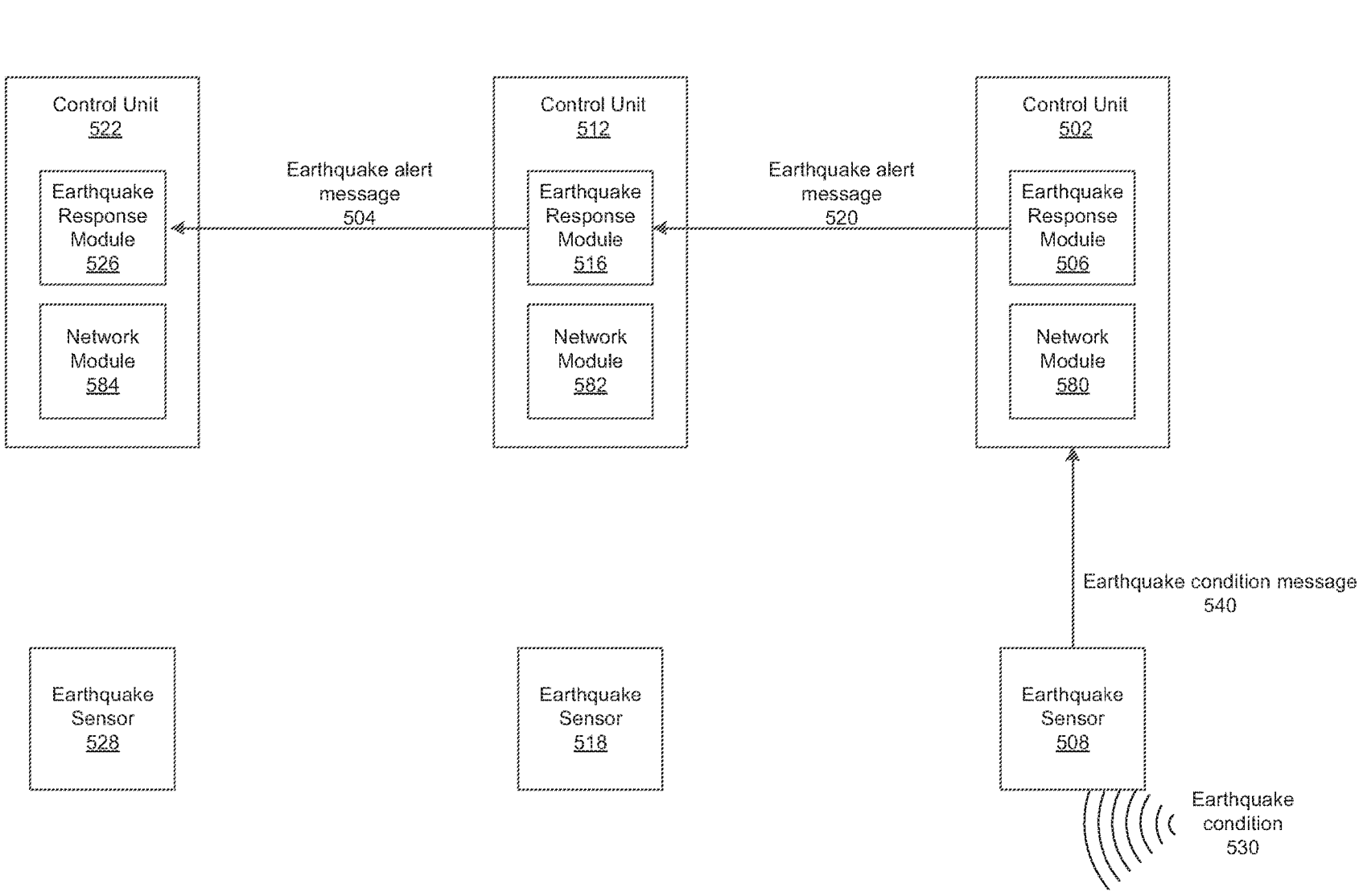
FIG. 5 is a schematic block diagram illustrating one embodiment of a system including multiple control units communicating messages with each other.

FIG. 5 shows an embodiment of a system 500 comprising a plurality of control units (control units 502, 512, and 522 respectively). FIG. 5 shows the control units 502, 512, and 522 including respective earthquake response modules 506, 516, and 526 and network modules 580, 582, and 584. The earthquake sensor 508 may be the first to detect the earthquake condition 530 and to generate the earthquake condition message 540 in response. The earthquake sensors 518 and 528 may similarly be configured to generate earthquake condition messages when they detect an earthquake condition 530; for example, when the earthquake sensors 518 and 528 may generate an earthquake condition message when the primary waves reach them.

The control units 502, 512, and 522 may be associated with separate security systems installed at separate facilities. In one embodiment, the control units 502, 512, and 522 are installed at unrelated facilities; for example, each of the control units 502, 512, and 522 may be for a separate residence within a geographic area.

In the embodiment shown in FIG. 5, the control units 502, 512, and 522 are communicatively connected to each other. The respective network modules 506, 516, and 526 may cooperate to maintain their respective control units 502, 512, and 522 as nodes in a network of control units. The control units 502, 512, and 522 may be communicatively connected by an Internet network, a cellular network, or other type of communications connection. The control units 502, 512, and 522 may thus be organized in a network.

In one embodiment, each control unit in the system 500 is associated with a unique address. The control units in the system 500 may be configured to send an earthquake alert message directly to one or more of the control units within the system 500. For example, in FIG. 5, the control unit 502 is configured to send the earthquake alert message 520 to the control unit 512, and the control unit 512 to send the earthquake alert message 504 to the control unit 522. The control units may send the earthquake alert messages using simple mail transfer protocol (SMTP), short message service (SMS), or other appropriate protocol.

In one embodiment, the control unit 502 is configured to send an earthquake condition message 502 to all other control units within a specified range of the control unit 502. The control unit 502 may, for example, send an earthquake alert message 520 to all control units within three miles of the control unit 502. In one embodiment, the control units (such as control unit 516) that receive the earthquake alert message 520 send an earthquake alert message 504 to other control units (such as control unit 522). The control unit 512 may be configured to send the earthquake alert message 504 only when the earthquake sensor 518 also detects the earthquake condition 530. Such an embodiment may prevent the earthquake alert message 520 from being passed to those control units that are too far from the earthquake condition 530 to feel the effects of the earthquake.

The earthquake response module 506 may generate and send the earthquake alert message 520 to the earthquake response module 516 of the control unit 512. The earthquake response module 516 may send the earthquake alert message 504 to the earthquake response module 526 of the control unit 522. In certain embodiments, the earthquake alert message 520 contains information about the earthquake condition 530 and the control unit 502. For example, the earthquake alert message 520 may contain data indicating the strength of the earthquake condition 530 and an identifier for the control unit 502. The earthquake response module 516 may be configured to determine the distance between the control unit 512 and the control unit 502. Based on the distance and the strength of the earthquake condition 530, the earthquake response module 516 may determine whether to send the earthquake alert message 504 to the control unit 522 before the earthquake condition 530 is independently detected by the earthquake sensor 518 associated with the control unit 512. For example, if the distance is less than two miles, and the earthquake alert message 520 indicates an intense earthquake, the earthquake response module 516 may send the earthquake alert message 504 without awaiting confirmation by the earthquake sensor 518.

The earthquake response module 526 may similarly examine the earthquake alert message 504. The earthquake response module 526 may determine, for example, that the distance between the control unit 522 and the earthquake sensor 508 that detected the earthquake condition 530 is ten miles. The earthquake response module 526 may determine, based on the distance separating the control unit 522 and the earthquake sensor 508, not to send a further earthquake alert message to another control unit at that time.

When the earthquake sensor 518 detects the earthquake condition 530, it may send a second earthquake alert message to the control unit 522. This second earthquake alert message may include data about the intensity of the earthquake condition 530 as measured by the earthquake sensor 518. The control unit 522 may then re-evaluate whether to send an earthquake alert message to other control units.

Similarly, the earthquake sensors may provide additional earthquake condition messages providing additional information as the earthquake event unfolds. For example, the earthquake sensor 508 may send the earthquake condition message 540 when it detects P waves. A second earthquake condition message may be sent when the earthquake sensor 508 senses the S waves. Additional earthquake condition messages may be sent describing the L waves and/or the R waves. The control unit 502 may send additional earthquake alert messages containing this additional information to other control units and/or the remote earthquake module 330 discussed in FIG. 4. Such embodiments may allow more accurate modeling based on the nature of the earthquake as recorded and provided by the earthquake sensors.

In certain embodiments, the system 500 and the system 400 may be combined such that control units are communicatively coupled with one or more additional control units, as described in FIG. 5, and are additionally communicatively coupled with a remote earthquake module 330, as described in FIG. 4. Such an embodiment may provide additional robustness and speed in propagating messages in response to an earthquake condition (such as earthquake condition 530).

The control units may be configured to send earthquake alert messages (directly and/or indirectly) to all control units within a given geographic region in response to any one control unit detecting an earthquake condition 530. For example, all control units along a fault line may be configured to send earthquake alert messages to other control units along the fault line.

Figure 6:
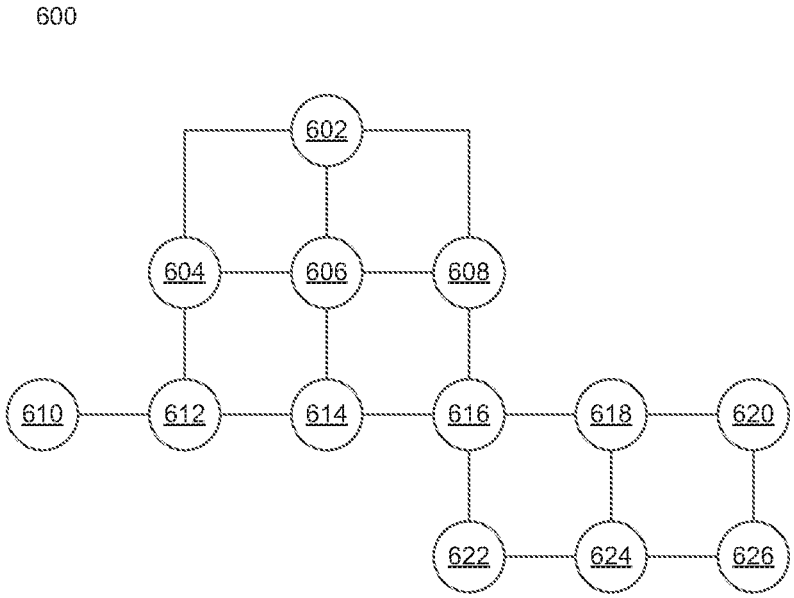
FIG. 6 is a graph representation of a network of control units.

FIG. 6 illustrates control units 602 through 626 as connected nodes. Each control unit 602-626 may have an associated earthquake sensor and earthquake response module as discussed above. Each earthquake response module may, in certain embodiments, have a set of separate earthquake response modules to notify in the event that: the earthquake response module receives an earthquake condition message from an associated earthquake sensor; the earthquake response module receives an earthquake alert message from another earthquake response module; or the earthquake response module receives an earthquake alert message from a remote earthquake module 330.

For example, in FIG. 6, the control unit 602 may be configured to send an earthquake alert message to addresses associated with the control units 604, 606, and 608 if its earthquake sensor detects an earthquake condition. The control unit 608 may be configured to send an earthquake alert message to addresses associated with the control units 602, 606, and 616 if its earthquake sensor detects an earthquake condition.

The control units may have rules for determining whether to send an earthquake alert message in response to receiving an earthquake alert message from another control unit. For example, the control unit 608 may be configured to send an earthquake alert message to only the control unit 616 in response to receiving an earthquake alert message from the control unit 602 since the control unit 608 may assume that the control unit 606 was alerted by the control unit 602, and that the control unit 602 (which detected the earthquake condition) does not require an earthquake alert message. Other rules for providing an appropriate flow of earthquake alert messages through the network 600 may also be implemented.

The control units 602-626 may each implement network modules as shown in FIG. 5. The network modules may be responsible for maintaining the network of control units 602-626. For example, the network modules may cooperate to heal problems in the network 600 if a control unit loses communication with the network 600. The network modules may also cooperate to maintain communications across the network 600.

Figure 7:
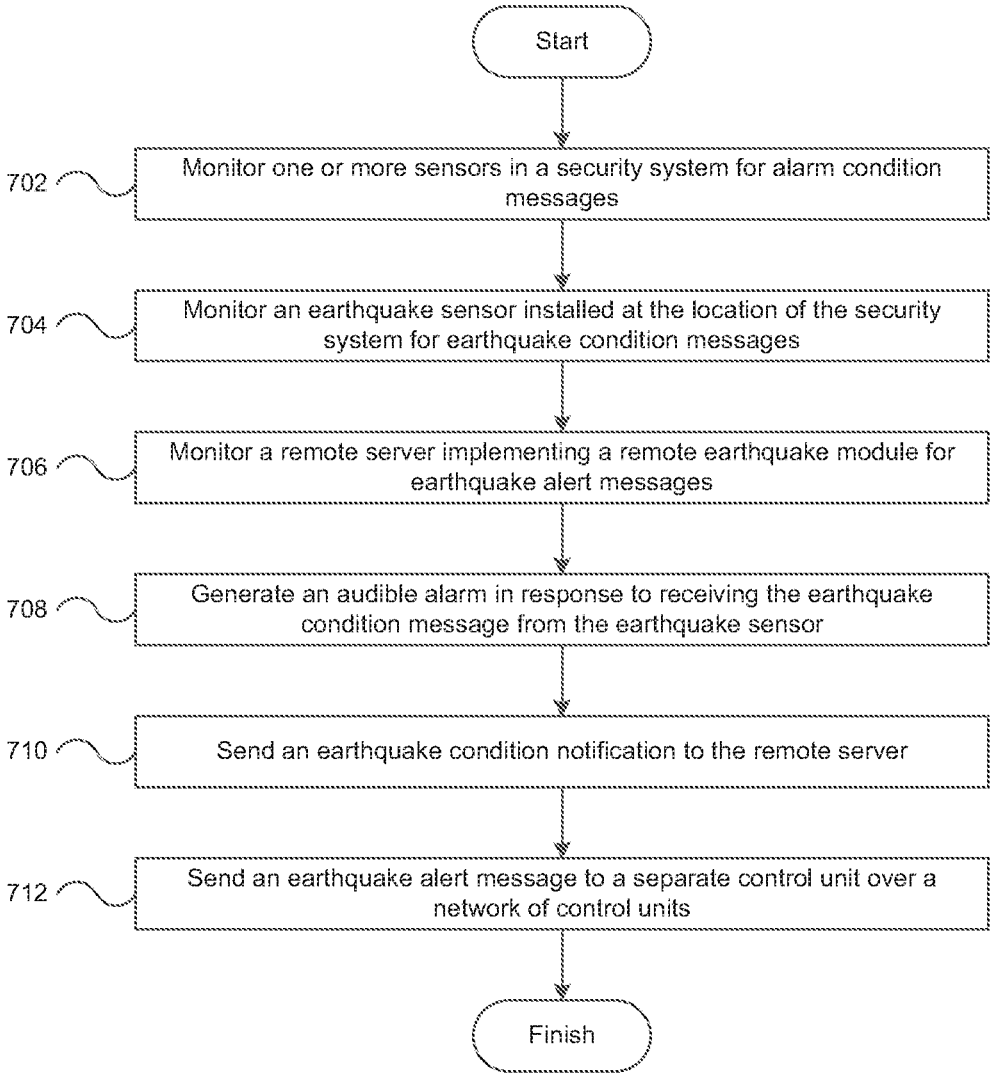
FIG. 7 is a flow chart diagram illustrating one embodiment of a method for sensing earthquake conditions and providing an alarm through a control unit.

FIG. 7 illustrates one embodiment of a method for providing an earthquake warning. The method may involve, at reference numeral 702, monitoring one or more sensors in a security system for alarm condition messages. For example, a control unit may monitor for alarm condition messages from glass-break sensors, door sensors, smoke detectors, and others. The method may also involve, at reference numeral 704, monitoring an earthquake sensor that is installed at the location of the security system for earthquake condition messages. The earthquake sensor may be configured to send the earthquake condition message if the earthquake sensor detects one or more earthquake conditions.

The method may also include, at reference numeral 706, monitoring a remote server implementing a remote earthquake module for earthquake alert messages. The remote earthquake module may generate the earthquake alert message if a control unit sends the remote earthquake module an earthquake condition notification as discussed in connection with FIG. 4. The remote earthquake module may send the earthquake condition notification if it receives an alert from a public earthquake early warning system. In certain embodiments, the method also involves monitoring one or more other control units and receiving an earthquake alert message from the remote control units over the network of control units, as discussed in FIGS. 5 and 6.

The method may include, at reference numeral 708, generating an audible alarm in response to receiving the earthquake condition message from the earthquake sensor. In one embodiment, a control unit may receive the earthquake condition message and generates the audible alarm that includes a verbal warning and instructions in anticipation of the earthquake. The control unit may also provide a visual alarm, such as flashing lights, in response to receiving the earthquake condition message. The method may also involve generating an audible alarm in response to receiving an earthquake alert message from the remote earthquake module or from another control unit that is in communication with the control unit implementing the method.

The method may further involve, at reference numeral 710, sending an earthquake condition notification to the remote server implementing the remote earthquake module. The method may also involve, at reference numeral 712, sending an earthquake alert message to a separate control unit over a network of control units, as described in connection with FIGS. 5 and 6. Such actions may help provide rapid notification of an impending earthquake and provide more warning time than detecting an earthquake condition (such as p waves) alone provides.

While the foregoing disclosure sets forth various embodiments using specific block diagrams, flowcharts, and examples, each block diagram component, flowchart step, operation, and/or component described and/or illustrated herein may be implemented, individually and/or collectively, using a wide range of hardware, software, or firmware (or any combination thereof) configurations. In addition, any disclosure of components contained within other components should be considered exemplary in nature since many other architectures can be implemented to achieve the same functionality.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

Furthermore, while various embodiments have been described and/or illustrated herein in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may configure a computing system to perform one or more of the exemplary embodiments disclosed herein.

The foregoing description, for purpose of explanation, has been described with reference to specific embodiments. However, the illustrative discussions above are not intended to be exhaustive or to limit the systems and methods to the precise forms disclosed. Many modifications and variations are possible in view of the above teachings. The embodiments were chosen and described in order to best explain the principles of the present systems and methods and their practical applications, to thereby enable others skilled in the art to best utilize the present systems and methods and various embodiments with various modifications as may be suited to the particular use contemplated.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising." In addition, the term "based on" as used in the specification and the claims is to be construed as meaning "based at least upon."

What is claimed is:

1. A method, comprising:

receiving, at a monitoring system of a security and automation system at a first location, a first message from a first seismic motion sensor indicating that a seismic motion condition has been detected, the monitoring system and the first seismic motion sensor being located at different locations;

analyzing the first message to identify one or more characteristics associated with the seismic motion condition;

analyzing a distance between the monitoring system of the security and automation system at the first location and the control unit at a second location based at least in part on a strength of the seismic motion condition indicated in the first message or analyzing the first message, or both; and transmitting a second message to a control unit based at least in part on analyzing the distance between the monitoring system and the control unit, the second message indicating that the seismic motion condition is imminent at the control unit, wherein transmitting the second message to the control unit occurs prior to the control unit receiving a third message from a second seismic motion sensor different from the first seismic motion sensor.

2. The method of claim 1, further comprising:

identifying the control unit at a second location different from the first location based at least in part on a distance between the first location and the second location.

3. The method of claim 1, further comprising:

identifying the strength of the seismic motion condition based at least in part on the first message.

4. The method of claim 1, wherein analyzing the first message further comprises:

implementing a model associated with the seismic motion condition to identify a scope and a character of the seismic motion condition, wherein transmitting the second message is based at least in part on the scope and the character of the seismic motion condition.

5. The method of claim 4, wherein the model associated with the seismic motion condition is based at least in part on locations of faults, historic patterns of seismic activity in a location, or a combination thereof.

6. The method of claim 4, further comprising:

predicting that an area will be affected related to the seismic motion condition based at least in part on the scope and the character of the seismic motion condition; and identifying additional control units located within the area, to receive the second message.

7. The method of claim 1, wherein the second message is an earthquake alert message.

8. The method of claim 1, further comprising:

generating an alarm at the first location based at least in part on information included in the first message.

9. The method of claim 1, wherein the first message is communicated via a first communication link that is different from a second communication link used to communicate the second message.

10. An apparatus to communicate messages, comprising:

a processor;

a memory in electronic communication with the processor; and instructions stored in the memory, the instructions being executable by the processor to:

receive, at a monitoring system of a security and automation system at a first location, a first message from a first seismic motion sensor indicating that a seismic motion condition has been detected, the monitoring system and the first seismic motion sensor being located at different locations;

analyze the first message to identify one or more characteristics associated with the seismic motion condition;

analyze a distance between the monitoring system of the security and automation system at the first location and the control unit at a second location based at least in part on a strength of the seismic motion condition indicated in the first message or analyzing the first message, or both; and transmit a second message to a control unit based at least in part on analyzing the distance between the monitoring system and the control unit, the second message indicating that the seismic motion condition is imminent at the control unit, wherein transmitting the second message to the control unit occurs prior to the control unit receiving a third message from a second seismic motion sensor different from the first seismic motion sensor.

11. The apparatus of claim 10, wherein the instructions are further executable by the processor to:

identify the control unit at a second location different from the first location based at least in part on a distance between the first location and the second location.

12. The apparatus of claim 10, wherein the instructions are further executable by the processor to:

identify the strength of the seismic motion condition based at least in part on the first message.

13. The apparatus of claim 10, wherein the instructions are further executable by the processor to:

implement a model associated with the seismic motion condition to identify a scope and a character of the seismic motion condition, wherein transmitting the second message is based at least in part on the scope and the character of the seismic motion condition.

14. The apparatus of claim 13, wherein the model associated with the seismic motion condition is based at least in part on locations of faults, historic patterns of seismic activity in a location, or a combination thereof.

15. The apparatus of claim 13, wherein the instructions are further executable by the processor to:

predict that an area will be affected related to the seismic motion condition based at least in part on the scope and the character of the seismic motion condition; and identify additional control units located within the area, to receive the second message.

16. The apparatus of claim 10, wherein the second message is an earthquake alert message.

17. The apparatus of claim 10, wherein the instructions are further executable by the processor to:

generate an alarm at the first location based at least in part on information included in the first message.

18. The apparatus of claim 10, wherein the first message is communicated via a first communication link that is different from a second communication link used to communicate the second message.

19. A non-transitory computer-readable medium storing computer-executable code, the code executable by a processor to:

receive, at a monitoring system of a security and automation system at a first location, a first message from a first seismic motion sensor indicating that a seismic motion condition has been detected, the monitoring system and the first seismic motion sensor being located at different locations;

analyze the first message to identify one or more characteristics associated with the seismic motion condition;

analyze a distance between the monitoring system of the security and automation system at the first location and the control unit at a second location based at least in part on a strength of the seismic motion condition indicated in the first message or analyzing the first message, or both; and transmit a second message to a control unit based at least in part on analyzing the distance between the monitoring system and the control unit, the second message indicating that the seismic motion condition is imminent at the control unit, wherein transmitting the second message to the control unit occurs prior to the control unit receiving a third message from a second seismic motion sensor different from the first seismic motion sensor.

20. The non-transitory computer-readable medium of claim 19, wherein the code further executable by the processor to:

identify the control unit at a second location different from the first location based at least in part on a distance between the first location and the second location.

* * * * *